US009105970B1

(12) United States Patent
Heinrich

(10) Patent No.: US 9,105,970 B1
(45) Date of Patent: Aug. 11, 2015

(54) BALLOON PAYLOAD WITH BALLOON-TO-BALLOON COMMUNICATIONS AND AVIONICS ON TOP

(71) Applicant: Google Inc., Mountain View, CA (US)

(72) Inventor: Mitchell Joseph Heinrich, San Francisco, CA (US)

(73) Assignee: Google Inc., Mountain View, CA (US)

( * ) Notice: Subject to any disclaimer, the term of this patent is extended or adjusted under 35 U.S.C. 154(b) by 227 days.

(21) Appl. No.: 13/918,541

(22) Filed: Jun. 14, 2013

(51) Int. Cl.
*H01Q 1/28* (2006.01)

(52) U.S. Cl.
CPC ..... *H01Q 1/28* (2013.01)

(58) Field of Classification Search
CPC ..... H01Q 1/28; H01Q 1/1292; H01Q 1/30
See application file for complete search history.

(56) References Cited

U.S. PATENT DOCUMENTS

| | | | | |
|---|---|---|---|---|
| 5,575,438 | A * | 11/1996 | McGonigle et al. | 244/13 |
| 7,046,934 | B2 | 5/2006 | Badesha et al. | |
| 7,356,390 | B2 | 4/2008 | Knoblach et al. | |
| 7,469,857 | B2 | 12/2008 | Voss | |
| 7,913,948 | B2 | 3/2011 | Porter | |
| 8,061,647 | B1 | 11/2011 | Powell | |
| 2012/0083945 | A1 * | 4/2012 | Oakley et al. | 701/2 |
| 2014/0042199 | A1 * | 2/2014 | Gregory, Jr. | 224/401 |
| 2014/0177863 | A1 * | 6/2014 | Parkins | 381/74 |
| 2014/0333491 | A1 * | 11/2014 | Behroozi et al. | 343/706 |

* cited by examiner

*Primary Examiner* — Trinh Dinh
(74) *Attorney, Agent, or Firm* — McDonnell Boehnen Hulbert & Berghoff LLP

(57) ABSTRACT

The present disclosure provides a balloon payload with communications and avionics on positioned on top. The payload may include a chassis and an avionics system coupled to the first chassis. The payload may also include a battery coupled to the first chassis and positioned below the avionics system. The payload may additionally include an air-to-ground communications antenna coupled to the first chassis and positioned below the battery portion and the avionics portion.

20 Claims, 7 Drawing Sheets

BALLOON PAYLOAD WITH BALLOON-TO-BALLOON COMMUNICATIONS AND AVIONICS ON TOP

BACKGROUND

Unless otherwise indicated herein, the materials described in this section are not prior art to the claims in this application and are not admitted to be prior art by inclusion in this section.

Computing devices such as personal computers, laptop computers, tablet computers, cellular phones, and countless types of Internet-capable devices are increasingly prevalent in numerous aspects of modern life. As such, the demand for data connectivity via the Internet, cellular data networks, and other such networks, is growing. However, there are many areas of the world where data connectivity is still unavailable, or if available, is unreliable and/or costly. Accordingly, additional network infrastructure is desirable.

SUMMARY

Within examples, a balloon payload is disclosed that is configured in a manner that provides balloon-to-balloon communications and avionics on a top portion of the payload.

In a first aspect, a balloon payload is provided. The balloon payload may include a first chassis. The balloon payload may also include an avionics system coupled to the first chassis. The balloon payload may additionally include a battery coupled to the first chassis and positioned below the avionics system. The balloon payload may further include an air-to-ground communications antenna coupled to the first chassis and positioned below the battery and the avionics system.

In a second aspect, another balloon is provided. The balloon may include an envelope and a balloon payload. The balloon payload may include a first chassis. The balloon payload may also include an avionics system coupled to the first chassis. The balloon payload may additionally include a battery coupled to the first chassis and positioned below the avionics system. The balloon payload may further include an air-to-ground communications antenna coupled to the first chassis and positioned below the battery and the avionics system.

In a third aspect, yet another balloon is provided. The balloon may include an envelope and a balloon payload. The balloon payload may include a first chassis. The balloon payload may also include an avionics system coupled to the first chassis. The balloon payload may additionally include a battery coupled to the first chassis and positioned below the avionics system. The balloon payload may further include an air-to-ground communications antenna coupled to the first chassis and positioned below the battery and the avionics system. The balloon payload may yet even further include one or more balloon-to-balloon communication antennas substantially positioned above the avionics system, the battery, and the air-to-ground communications antenna.

These as well as other aspects, advantages, and alternatives, will become apparent to those of ordinary skill in the art by reading the following detailed description, with reference where appropriate to the accompanying drawings.

DETAILED DESCRIPTION

Figure 1:
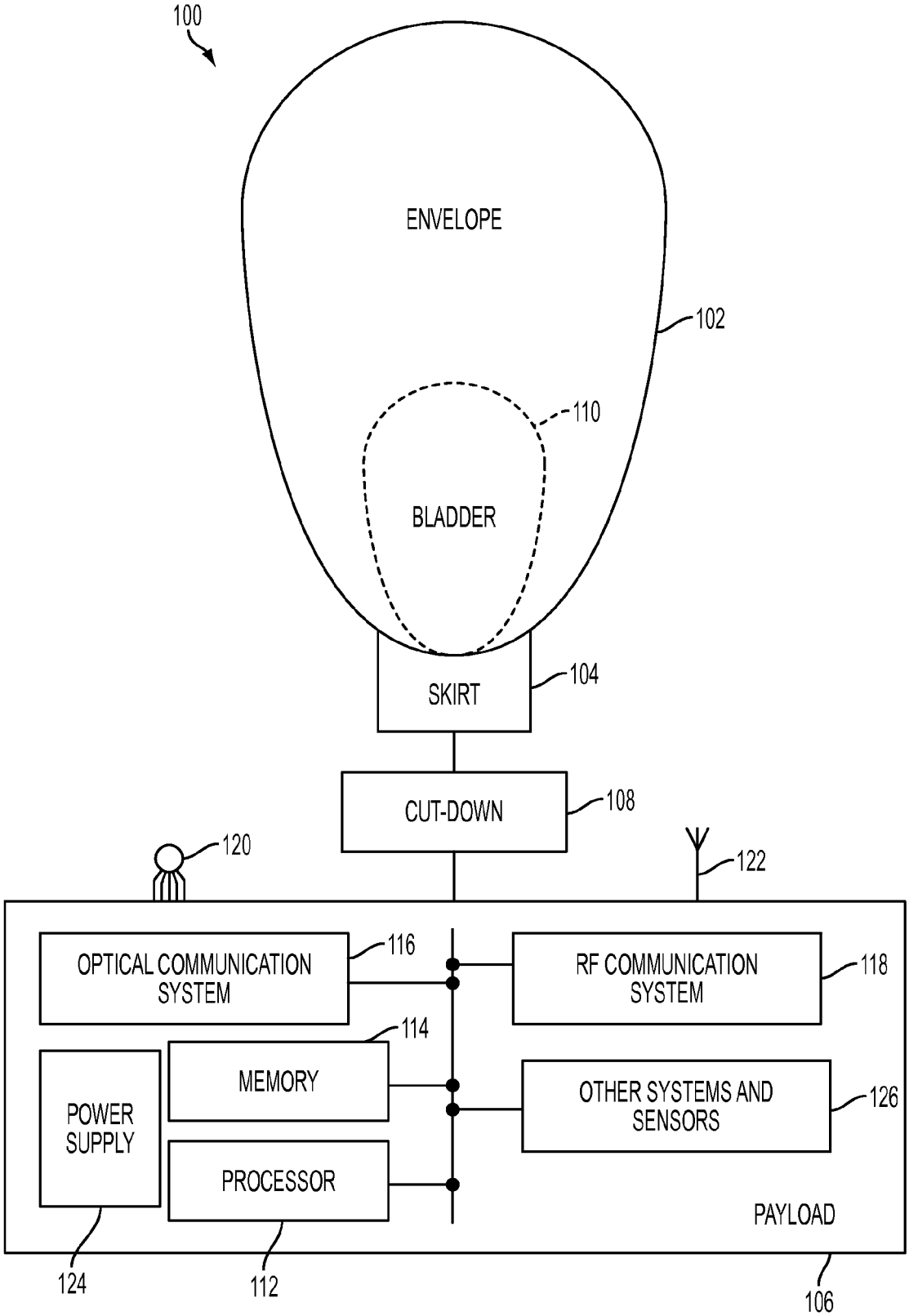
FIG. 1 is a simplified block diagram illustrating a high-altitude balloon, according to an exemplary embodiment.

Exemplary methods and systems are described herein. It should be understood that the word "exemplary" is used herein to mean "serving as an example, instance, or illustration." Any embodiment or feature described herein as "exemplary" is not necessarily to be construed as preferred or advantageous over other embodiments or features. The exemplary embodiments described herein are not meant to be limiting. It will be readily understood that certain aspects of the disclosed systems and methods can be arranged and combined in a wide variety of different configurations, all of which are contemplated herein.

Furthermore, the particular arrangements shown in the Figures should not be viewed as limiting. It should be understood that other embodiments may include more or less of each element shown in a given Figure. Further, some of the illustrated elements may be combined or omitted. Yet further, an exemplary embodiment may include elements that are not illustrated in the Figures.

I. Overview

Example embodiments may generally relate to a data network formed by balloons, and in particular, to a mesh network formed by high-altitude balloons deployed in the stratosphere. In order that the balloons may provide a reliable mesh network in the stratosphere, where winds may affect the locations of the various balloons in an asymmetrical manner, the balloons in an exemplary network may be configured move latitudinally and/or longitudinally relative to one another by adjusting their respective altitudes, such that the wind carries the respective balloons to the respectively desired locations.

Each balloon in the balloon network may include a payload that generally houses the components of the balloon that may allow it to both operate and communicate with the other balloons in the balloon network. Such components may include power-electronics, avionics, antennas, and power (e.g., a battery) to name a few. Within examples, disclosed is a payload of a balloon that may include an enclosure that includes three portions, each enclosing different components of the balloon. For example, a first portion may house avionics of the balloon (e.g., an automatic dependent surveillance-broadcast (ADSB) transponder), a second component may house a battery, and a third component may house an antenna. The portions may be configured in manner such that the first portion is substantially at a top portion of the payload housing the avionics, the second portion is substantially in a middle portion of the payload housing the battery, and the third component is substantially at a bottom portion of the payload housing the antenna.

Configuring the payload in this manner may have certain advantages. For example, housing avionics of the balloon at the top of the payload may provide a separation for inter-balloon communication (communication between other balloons in the balloon network) and any ground communication (e.g., between a given balloon and a wireless communication device on the ground). Other advantages may include helping to maintain the lifetime of communication equipment by protecting more expensive components of the balloon (such as the avionics) while sacrificing other less expensive components of the balloon (such as the antenna) when the balloon lands or crashes, for example. Moreover, temperature management may be performed in a more efficient and effective manner. Other advantages to the disclosed payload structure may be apparent and will be discussed throughout this disclosure.

II. Exemplary Balloon Configuration

Various types of balloon systems may be incorporated in an exemplary balloon network. An exemplary embodiment may utilize high-altitude balloons, which typically operate in an altitude range between 17 km and 22 km. FIG. 1 is a simplified block diagram illustrating a high-altitude balloon 100, according to an exemplary embodiment. As shown, the balloon 100 includes an envelope 102, a skirt 104, a payload 106, and a cut-down system 108 that is attached between the envelope 102 and payload 106.

The envelope 102 and skirt 104 may take various forms, which may be currently well-known or yet to be developed. For instance, the envelope 102 and/or skirt 104 may be made of a highly-flexible latex material or may be made of a rubber material such as chloroprene. Other materials are also possible. Further, the shape and size of the envelope 102 and skirt 104 may vary depending upon the particular implementation. Additionally, the envelope 102 may be filled with various different types of gases, such as helium and/or hydrogen. Other types of gases are possible as well.

The payload 106 of balloon 100 may include a processor 112 and on-board data storage, such as memory 114. The memory 114 may take the form of or include a non-transitory computer-readable medium. The non-transitory computer-readable medium may have instructions stored thereon, which can be accessed and executed by the processor 112 in order to carry out the balloon functions described herein.

The payload 106 of balloon 100 may also include various other types of equipment and systems to provide a number of different functions. For example, payload 106 may include optical communication system 116, which may transmit optical signals via an ultra-bright LED system 120, and which may receive optical signals via an optical-communication receiver (e.g., a photo-diode receiver system). Further, payload 106 may include an RF communication system 118, which may transmit and/or receive RF communications via an antenna system 122. The payload 106 may also include a power supply 124 to supply power to the various components of balloon 100.

Further, payload 106 may include various types of other systems and sensors 126. For example, payload 106 may include one or more video and/or still cameras, a GPS system, various motion sensors (e.g., accelerometers, gyroscopes, and/or compasses), and/or various sensors for capturing environmental data. Further, some or all of the components within payload 106 may be implemented in a radiosonde, which may be operable to measure, e.g., pressure, altitude, geographical position (latitude and longitude), temperature, relative humidity, and/or wind speed and/or direction, among other information.

As noted, balloon 106 includes an ultra-bright LED system 120 for free-space optical communication with other balloons. As such, optical communication system 116 may be configured to transmit a free-space optical signal by modulating the ultra-bright LED system 120. The optical communication system 116 may be implemented with mechanical systems and/or with hardware, firmware, and/or software. Generally, the manner in which an optical communication system is implemented may vary, depending upon the particular application.

In a further aspect, balloon 100 may be configured for altitude control. For instance, balloon 100 may include a variable buoyancy system, which is configured to change the altitude of the balloon 100 by adjusting the volume and/or density of the gas in the balloon 100. A variable buoyancy system may take various forms, and may generally be any system that can change the volume and/or density of gas in envelope 102.

In an exemplary embodiment, a variable buoyancy system may include a bladder 110 that is located inside of envelope 102. The buoyancy of the balloon 100 may therefore be adjusted by changing the density and/or volume of the gas in bladder 110. To change the density in bladder 110, balloon 100 may be configured with systems and/or mechanisms for heating and/or cooling the gas in bladder 110. Further, to change the volume, balloon 100 may include pumps or other features for adding gas to and/or removing gas from bladder 110. Additionally or alternatively, to change the volume of bladder 110, balloon 100 may include release valves or other features that are controllable to allow air to escape from bladder 110.

Further, a balloon 106 may include a navigation system (not shown). The navigation system may implement station-keeping functions to maintain position within and/or move to a position in accordance with a desired topology. In particular, the navigation system may use altitudinal wind data to determine altitudinal adjustments that result in the wind carrying the balloon in a desired direction and/or to a desired location. The altitude-control system may then make adjustments to the density of the balloon chamber in order to effectuate the determined altitudinal adjustments and cause the balloon to move laterally to the desired direction and/or to the desired location. Alternatively, the altitudinal adjustments may be computed by a ground-based control system and communicated to the high-altitude balloon.

As shown, the balloon 100 also includes a cut-down system 108. The cut-down system 108 may be activated to separate the payload 106 from the rest of balloon 100. This functionality may be utilized anytime the payload needs to be accessed on the ground, such as when it is time to remove balloon 100 from a balloon network, when maintenance is due on systems within payload 106, and/or when power supply 124 needs to be recharged or replaced.

In an alternative arrangement, a balloon may not include a cut-down system. In such an arrangement, the navigation system may be operable to navigate the balloon to a landing location, in the event the balloon needs to be removed from the network and/or accessed on the ground. Further, it is possible that a balloon may be self-sustaining, such that it theoretically does not need to be accessed on the ground.

Figure 2A:
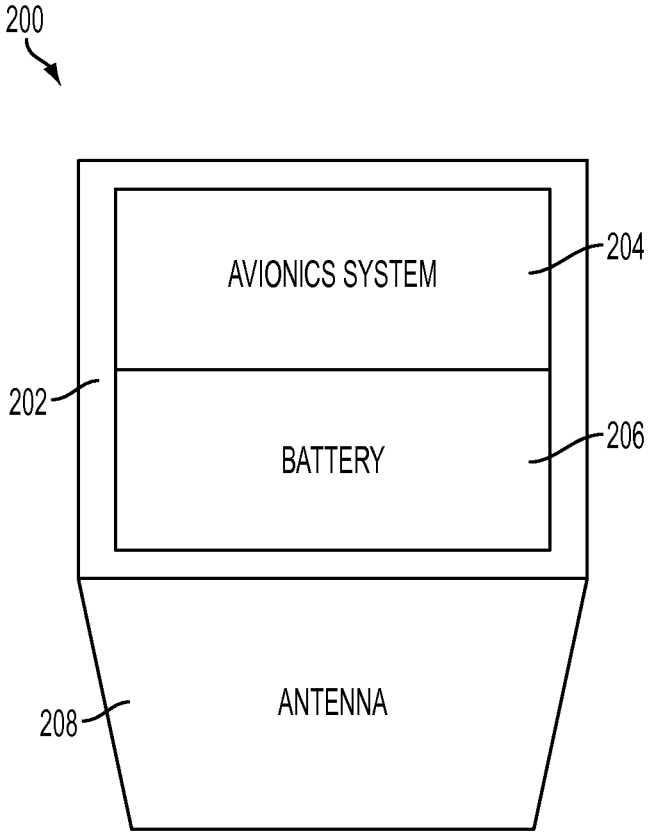
FIG. 2A is a schematic of a balloon payload according to an exemplary embodiment.

III. Example Balloon Payload With Balloon-to-Balloon Communications and Avionics on Top As discussed above, each balloon in the balloon network may include a payload. The payload may include a first chassis, an avionics system, a battery, and an air-to-ground communications antenna. FIG. 2A illustrates a schematic of a payload 200 according to an exemplary embodiment. Payload 200 may be similar to or the same as payload 106 described in reference to FIG. 1, and may be part of a balloon the same as or similar to balloon 100 of FIG. 1. Payload 200 may include a chassis 202 that houses (or encapsulates) three components: an avionics system 204, a battery 206, and an antenna 208. While shown in FIG. 2A, as a single structure, in some examples chassis 202 may include multiple structures or pieces that define the structure of payload 200. Chassis 202 may, for example, be made of sheet-metal or any other material that may provide structure to the payload.

Avionics system 204 may be substantially positioned at a top portion of chassis 202. Avionics system 204 may include any of the communication devices and/or navigation devices described above with regard to FIG. 1. For example, avionics system 204 may include the components of the other sensors and systems 126 (e.g., a GPS System) as well as optical communication system 116. In other examples, avionics system 204 may include an automatic dependent surveillance-broadcast (ADSB) transponder. Other avionics systems and arrangements may be included in avionics system 204 as well.

Battery 206 may be coupled to chassis 202 and may be positioned below the avionics system 204 and above the air-to-ground communications antenna 208. Battery 206 may be used to power the balloon. Battery 206 may be the same as or similar to that of power supply 124, for example. Placing battery 206 below the avionics system 204 and above the air-to-ground communications antenna 208 may facilitate and/or maintain the center of gravity for payload 200. In other words, positioning battery 206 in this manner may ensure payload 200 remains upright when landing, and may thereby ensure the potentially more expensive avionics system 204 remains on top and is not, for example, smashed by battery 206 when payload 200 hits the ground.

In some examples battery 206 may be substantially enclosed inside a battery jacket (not shown). The battery jacket may be made of foam and may fit around at least a portion of the battery. The battery jacket may be used to elevate the temperature of battery 206 in comparison to the remaining components of the assembly of payload 200 (e.g., the avionics system 204).

In further examples, chassis 202 may also include a radio and networking computer (now shown) that may be positioned next to battery 206. Positioning the radio and networking computer next to battery 206 may allow the components to remain close to any air-to-ground communications (e.g., air-to-ground antennas) that may be associated with balloon 100, which is discussed more in detail below. In yet even further examples, battery portion 206 may also include a router or other electronics that may facilitate communications associated with the balloon.

Figure 3:
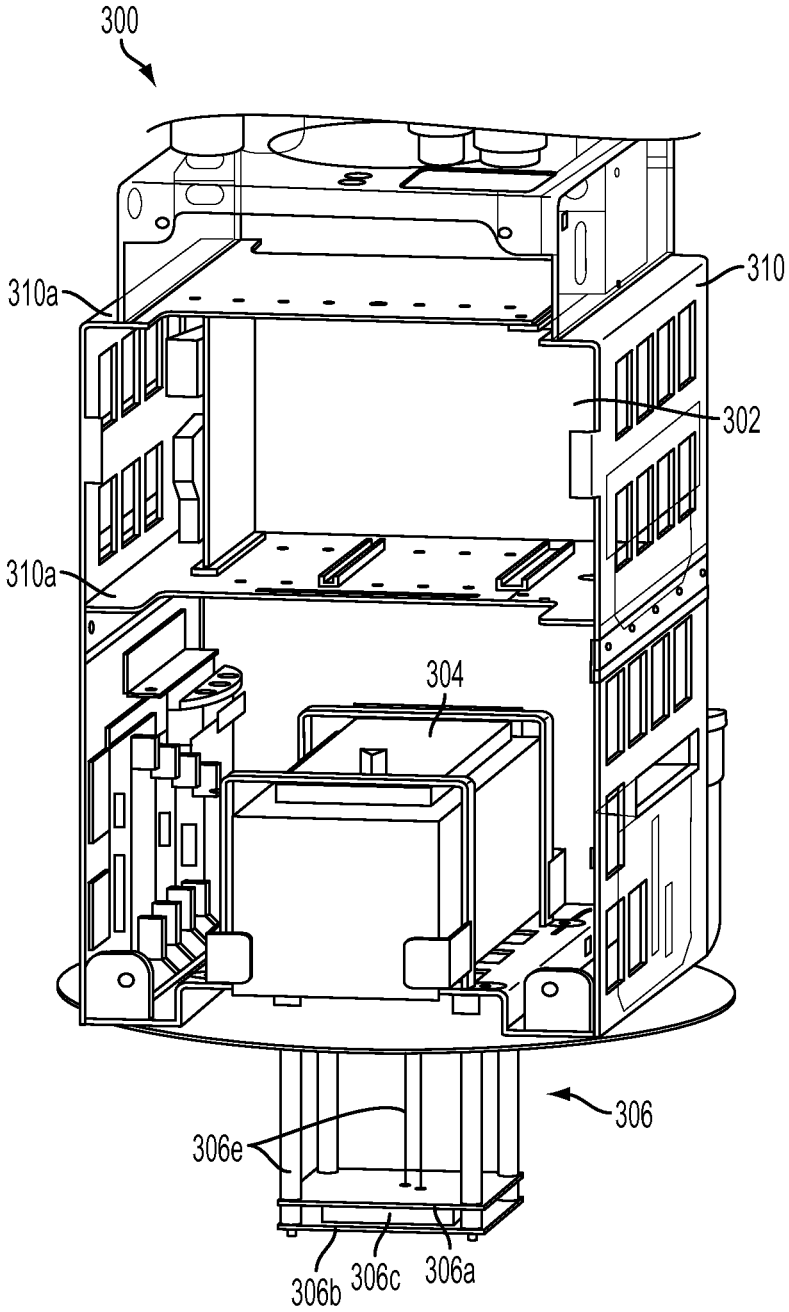
FIG. 3 is an example balloon payload according to an exemplary embodiment.

Antenna 208 may be an air-to-ground communications antenna that is substantially positioned below the battery portion 206 and the avionics portion 204. Air-to-ground communications 208 may also be coupled to the first chassis. In some examples, antenna 208 may include an antenna system such as antenna system 122 described in reference to FIG. 1. In other examples the antenna may be a patch antenna with a 90 degree field of view. The antenna may, for example, be made of fiberglass material such as FR4 or a similar reinforced plastic and copper. Other materials may be used in the patch antenna as well. An example of antenna 208 is shown in FIG. 3 as 306. In FIG. 3, the antenna 306 may include two FR4 panels 306*a*, 306*b* that cover a copper plate 306*c*. The antenna 306 may be supported and coupled to payload 300 via posts 306*e*.

Returning to FIG. 2A, because the antenna 208 may be cheaply manufactured it may be positioned below avionics system 204 and battery 206, the lowest portion of the payload assembly. Accordingly, as noted above, antenna 208 may be sacrificed when payload 200 hits or lands on the ground in exchange for the more expensive components of the payload such as the battery 206 and avionics system 204. Additionally, because antenna 208 is positioned at the bottom portion of the payload assembly antenna 208 may have no radio obstructions.

Figure 2B:
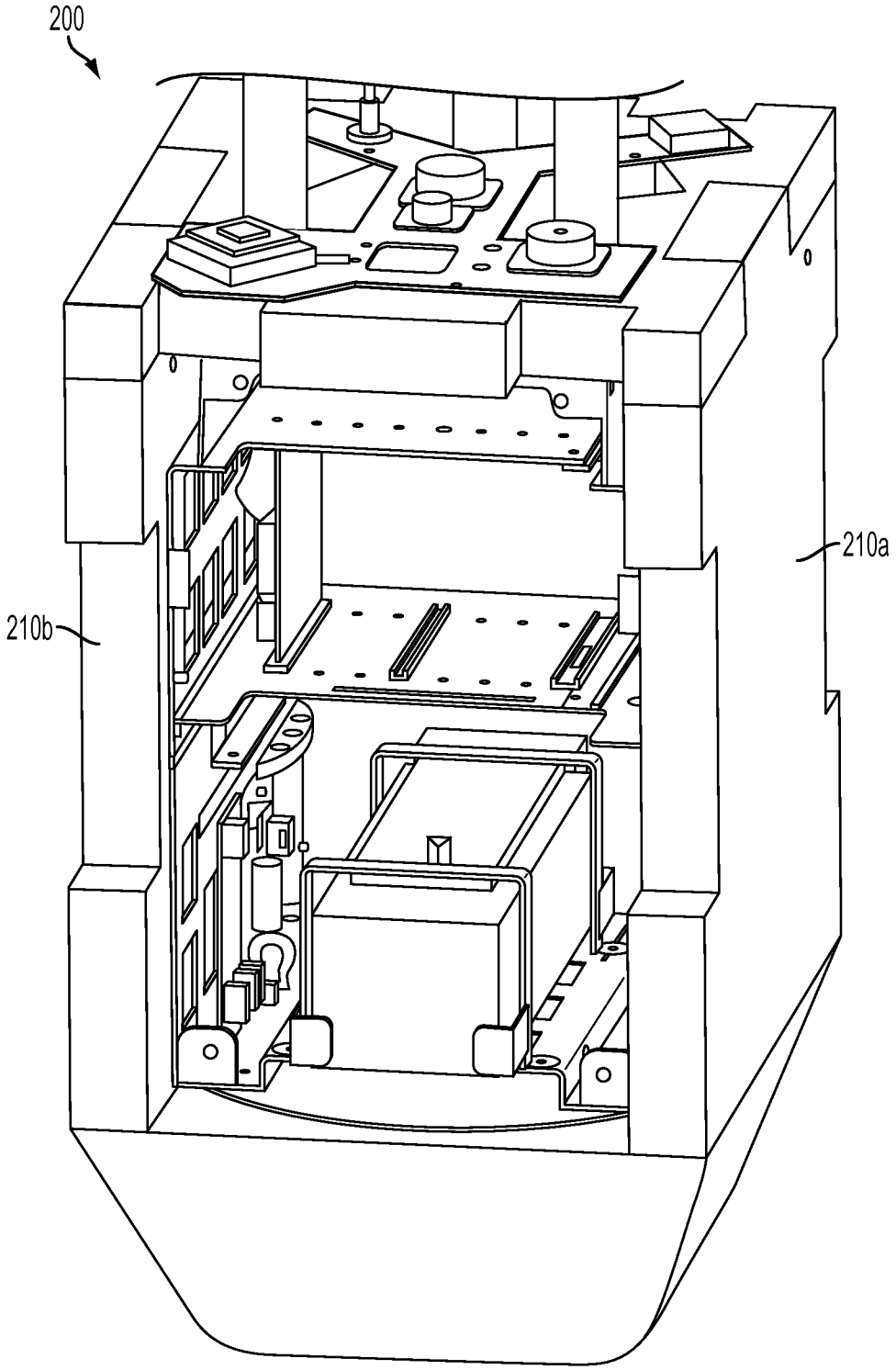
FIG. 2B is an example 3D view of a balloon payload similar to that of FIG. 2, according to an exemplary embodiment.
Figure 2C:
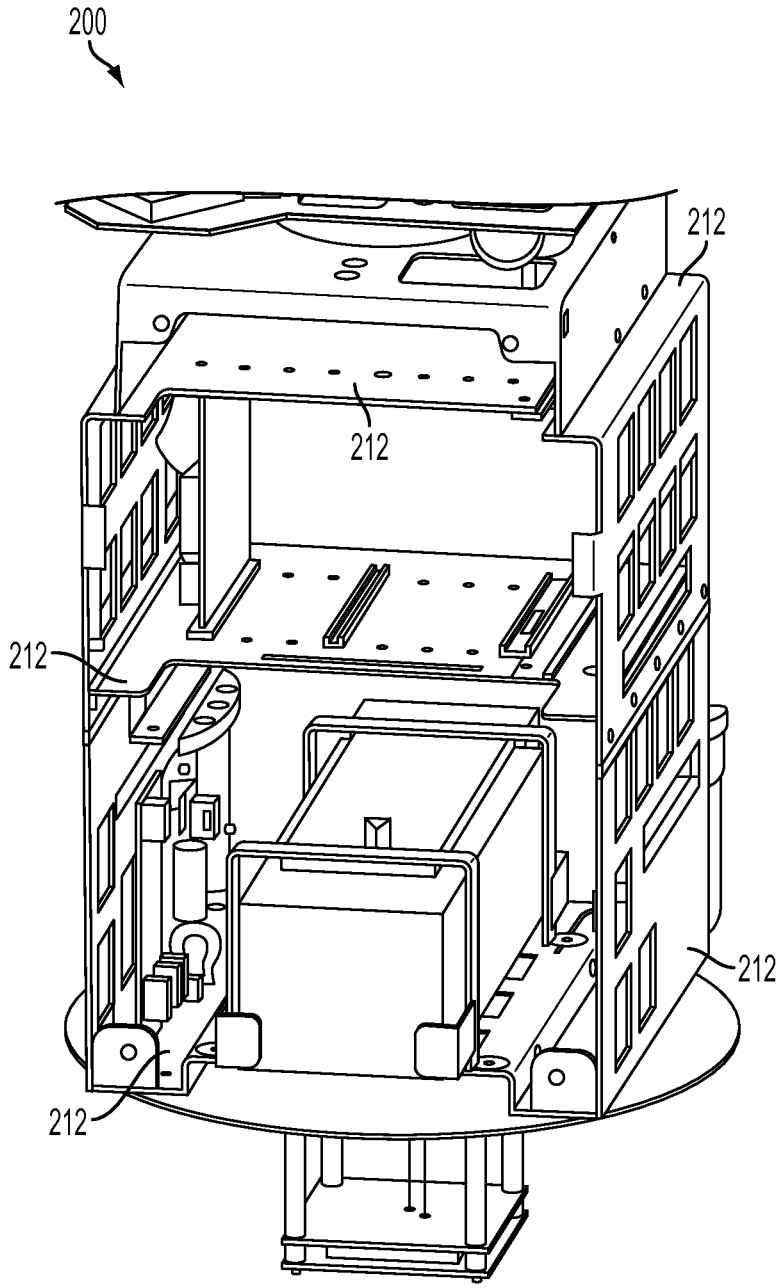
FIG. 2C is another example 3D view of a balloon payload similar to that of FIG. 2, according to an example embodiment.

FIGS. 2B and 2C illustrate example three-dimensional (3D) views of payload 200. In FIG. 2B, a 3D front view of a payload 200 is displayed. Because chassis 202 of payload 200 may be made of sheet metal, it may be difficult to manage temperatures associated with the portions due to the reflection and absorption of incoming and outgoing RF signals by the metal ails. To combat this problem, and in attempt to regulate temperatures associated with payload 200, payload 200 may also be configured in a manner such that the payload has increased dielectric properties thereby allowing payload 200 to be radio-frequency (RF) transparent. For example, payload 200 may be enclosed with an interlocking system using, for example, foam panels 210*a* and 210*b*. In other examples, payload 200 may be coated in foam. Various foams may be used including liquid foams, solid foams, or synthetic foams to name a few. In other examples, the foam may include a polyethylene or polystyrene insulation. Other means or measures may be taken to ensure the foam that encapsulates payload 200 is RF transparent as well. Configuring payload 200 in this manner may provide thermal insulation with little or no RF energy absorption.

In addition to the increased dielectric properties, payload 200 may be configured to be IR reflective. For instance, payload 200 may be coated in polyethylene (a shrink wrap) or any other synthetic, material, or film that includes IR-reflective pigment.

Chassis 202 may include metal plates that when positioned together create various portions that hold avionics system 204, battery 206, and air-to-ground communications antenna 208. In FIG. 2C, plates 212 represent example plates that may be used with chassis 202. The plates may take the form of sheet-metal made of aluminum, for example. Other metals may be used as well. Using card guides (not shown), the plates may be fit together to create individual portions that house avionics system 204, battery 206, and air-to-ground communications antenna 208. The card guides may, for example, be made of plastic and used to hold components of each portion in place. For instance, as noted above, using the card guides the payload 200 may generally restrict an avionics system 204 towards a top portion of chassis 202.

FIG. 3 illustrates a payload 300 according to another example embodiment. Payload 300 may be similar to or the same as payload 106 and 200 of FIGS. 1 and 2, and may be part of a balloon the same as or similar to balloon 100 of FIG. 1. Similar to payload 200, payload 300 may include an avionics system 302 (note the avionics components of the avionics system are not shown), battery 304, and air-to-ground communications 306. For example, avionics system 302 may include an avionics system similar to or the same as avionics system 204; battery 304 may be a battery similar to or the same as battery 206; and portion 306 may be the same as or similar to antenna 208.

In the embodiment shown in FIG. 3, avionics system 302 may include an avionics chassis 310 that may reside within the payload 300 and around the avionics system 302 (not shown). The chassis may be within a foam outer structure (e.g., shown in FIG. 2A) at a top portion of payload 300. Referring briefly to FIG. 2, the avionics chassis may be located within an upper portion of chassis 202 above battery 206. The chassis may, for example, include guides 310*a* or other mechanism features that may guide the particular components of the avionics system 302, and may thereby ensure the components remain steady and/or remain locked in place in the avionics chassis 310. Avionics chassis 310 may serve to protect the avionics system when a balloon associated with payload 300 crashes into or lands on the ground. Configuring avionics or an avionics system in avionics chassis 310 in this or a similar manner may, for example, protect the longevity of the avionics system as the chassis 310 may serve as further protection for the avionics system 302.

Figure 4:
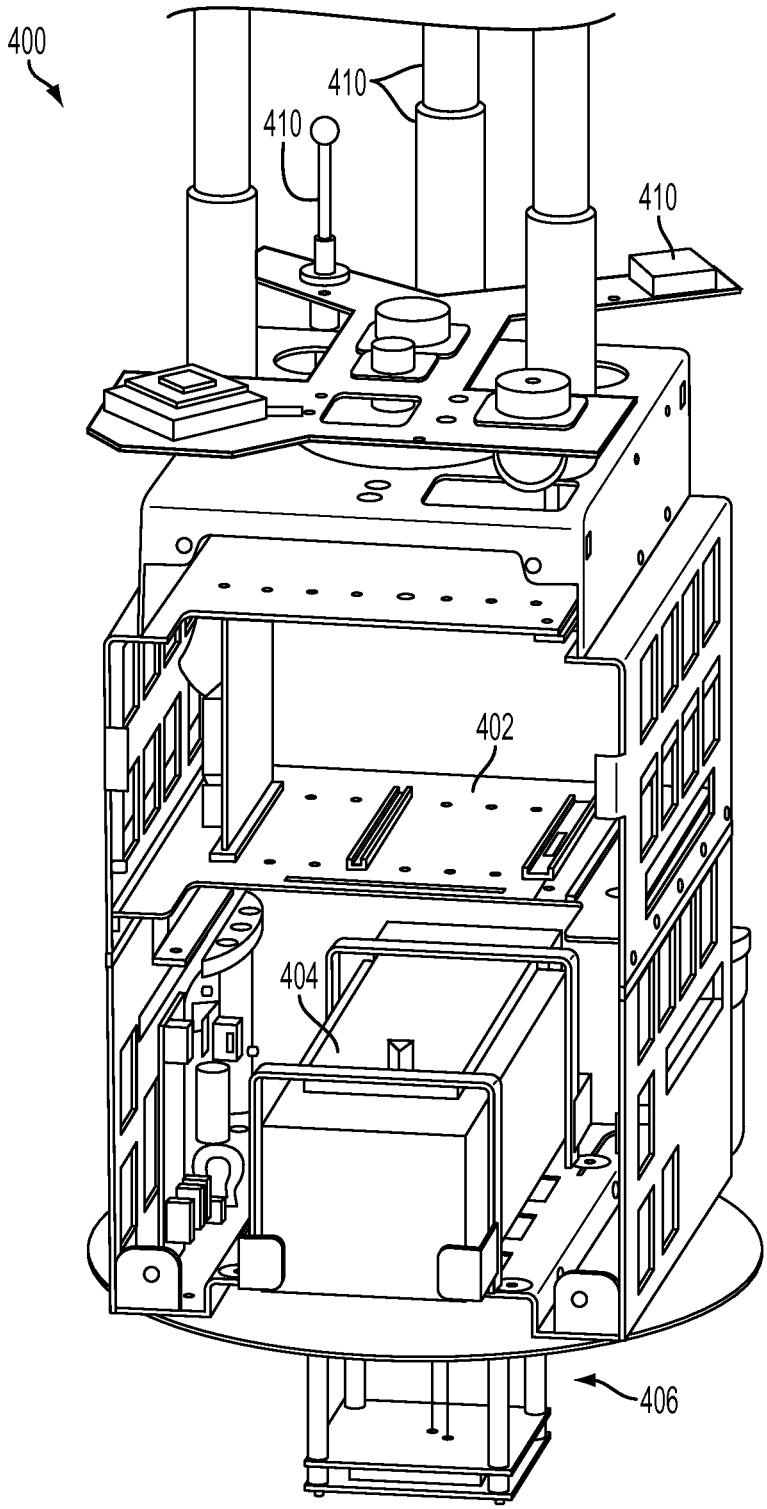
FIG. 4 is another example balloon payload configured such that balloon-to-balloon communications and avionics are on top, according to an exemplary embodiment.

FIG. 4 illustrates a payload 400 according to yet another example embodiment. Payload 400 may be similar to or the same as payload 106, 200, and 300 of FIGS. 1-3, and may be part of a balloon the same as or similar to balloon 100 of FIG. 1. Similar to payload 200 and payload 300, payload 400 may include avionics system 402, battery 404, and air-to-ground communication antenna 406. Avionics system 402 may include an avionics system similar to or the same as avionics system 204; battery 404 may be a battery similar to or the same as battery 206; and air-to-ground communications antenna 406 may be an antenna the same as or similar to antenna 208.

In FIG. 4, payload 400 may also include balloon-to-balloon communications 410 that may be substantially positioned at a top portion of payload 400. Balloon-to-balloon communications 410 may include, for example, an RF antenna, balloon-to-balloon antennas, iridium antennas, GPS antennas, and ADSB antennas to name a few. Other communication components and antennas may be included in balloon-to-balloon communications 410 as well. Placing the balloon-to-balloon communications at a top portion of the payload 400 in this manner may provide a separation from any balloon-to-balloon communications and any air-to-ground communications and may thereby prevent any interference between the two. Additionally, positioning the balloon-to-balloon communications at a top portion of payload 400 may allow the balloon-to-balloon communications a three-hundred-sixty degree view which may facilitate communication when balloons may be in constant positional flux with respect to each other and may be often spinning.

Figure 5:
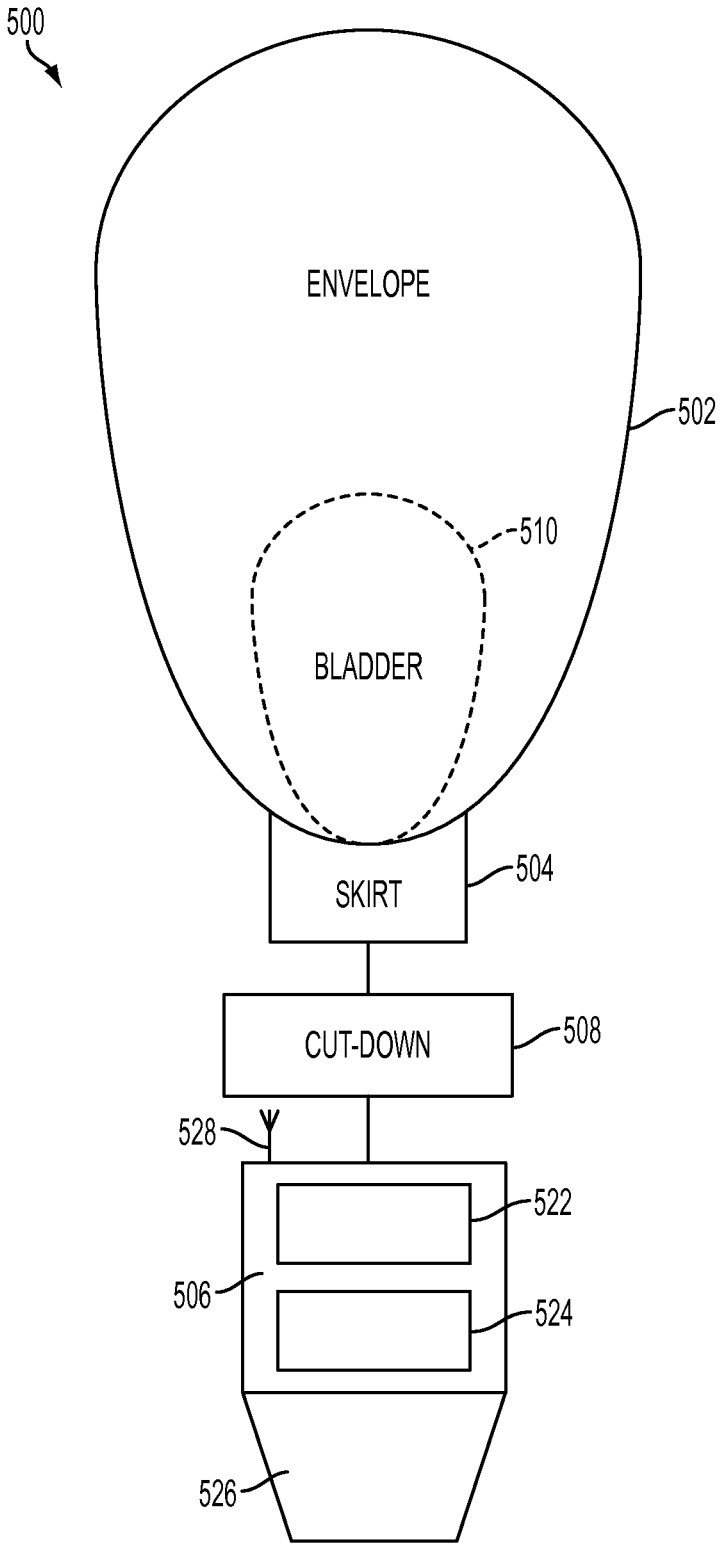
FIG. 5 is a simplified block diagram illustrating a high-altitude balloon with a payload with balloon-to-balloon communication and avionics on top, according to an example embodiment.

IV. Example Balloon Payload With Balloon-to-Balloon Communications and Avionics on Top in a High-Altitude Balloon FIG. 5 is a simplified block diagram illustrating a high-altitude balloon 500 with a payload structure that requires balloon-to-balloon communications and avionics to be on top, according to an exemplary embodiment. As discussed above in relation to FIG. 1, balloon 500 may include an envelope 502 and a bladder 504 that is located inside of envelope 502. In one embodiment, balloon 500 may include a payload 506 as described above. Such a payload 506 may be located at the bottom of balloon 500 and may house various components of the balloon 500. For example, payload 506 may house an avionics system 522; battery 524; and air-to-ground communications antenna 526. Avionics system 522, battery 524, and air-to-ground communications antenna 526 may be the same as or similar to components 204, 206, 208 discussed above with regard to FIG. 2. Moreover balloon-to-balloon communications 528 (e.g., an RF antenna) may be located at a top portion of payload 506.

As noted above, configuring the payload in this manner may provide a separation for inter-balloon communication and any air-to-ground ground communication. Other advantages may include maintaining a center of gravity of balloon 500 and helping to maintain the lifetime of communication equipment by protecting more expensive components of the balloon while sacrificing other less expensive components of the balloon when the balloon makes contact with the ground.

V. Conclusion

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

I claim:

1. A balloon payload comprising:

a first chassis;

an avionics system coupled to the first chassis;

a battery coupled to the first chassis and positioned below the avionics system; and an air-to-ground communications antenna coupled to the first chassis and positioned below the battery and the avionics system.

2. The balloon payload of claim 1, wherein the balloon payload further comprises one or more balloon-to-balloon communication antennas substantially positioned above the avionics system, the battery, and the air-to-ground communications antenna.

3. The balloon payload of claim 1, wherein the avionics system is coupled to the first chassis in a manner such that it is substantially within the first chassis;

wherein the battery is coupled to the first chassis in a manner such that it is substantially within the first chassis; and wherein the air-to-ground communications portion is coupled to the chassis in a manner such that it is outside the chassis.

4. The balloon payload of claim 1, wherein the balloon payload is coated in foam or made of foam.

5. The balloon payload of claim 1, wherein the balloon payload is configured to be Infrared (IR) reflective.

6. The balloon payload of claim 1, wherein the balloon payload is coated in polyethylene.

7. The balloon payload of claim 1, further comprising a second chassis that is coupled to the first chassis, wherein the second chassis is located within an upper portion of the first chassis above the battery, and wherein the avionics system is coupled to the second chassis.

8. The balloon payload of claim 1, wherein the balloon payload is configured to insulate at least one of the avionics system, the battery, or the air-to-ground communications antenna.

9. The balloon payload of claim 1, wherein the balloon payload is configured to be radio-frequency (RF) transparent.

10. The balloon payload of claim 1, wherein the air-to-ground communications antenna comprises a patch antenna.

11. The balloon payload of claim 1, wherein the avionics system comprises at least one of a global positioning system (GPS) or an automatic dependent surveillance-broadcast (ADSB) transponder.

12. A balloon comprising:

an envelope; and a balloon payload comprising:

a first chassis;

an avionics system coupled to the first chassis;

a battery coupled to the first chassis and positioned below the avionics system; and an air-to-ground communications antenna coupled to the first chassis and positioned below the battery and the avionics system.

13. The balloon of claim 12, wherein the balloon payload further comprises one or more balloon-to-balloon communication antennas substantially positioned above the avionics system, the battery, and the air-to-ground communications antenna.

14. The balloon of claim 12, wherein the avionics system is coupled to the first chassis in a manner such that it is substantially within the first chassis;

wherein the battery is coupled to the first chassis in a manner such that it is substantially within the first chassis; and wherein the air-to-ground communications portion is coupled to the chassis in a manner such that it is outside the chassis.

15. The balloon of claim 12, wherein the balloon payload is coated in foam or made of foam.

16. The balloon of claim 12, wherein the balloon payload is coated in polyethylene.

17. The balloon of claim 12, wherein the balloon payload is configured to be IR reflective.

18. The balloon of claim 12, further comprising a second chassis that is coupled to the first chassis, wherein the second chassis is located within an upper portion of the first chassis above the battery, and wherein the avionics system is coupled to the second chassis.

19. The balloon of claim 12, wherein the avionics system comprises at least one of a global positioning system (GPS) or an automatic dependent surveillance-broadcast (ADSB) transponder.

20. A balloon comprising:

an envelope; and a balloon payload comprising:

a first chassis;

an avionics system coupled to the first chassis;

a battery coupled to the first chassis and positioned below the avionics system; and an air-to-ground communications antenna coupled to the first chassis and positioned below the battery and the avionics system; and one or more balloon-to-balloon communication antennas substantially positioned above the avionics system, the battery, and the air-to-ground communications antenna.

* * * * *